US009281603B2

(12) United States Patent
Cullins

(10) Patent No.: US 9,281,603 B2
(45) Date of Patent: Mar. 8, 2016

(54) DATA CONNECTOR AND LABELING APPARATUS

(71) Applicant: Mitchell J Cullins, Encinitas, CA (US)

(72) Inventor: Mitchell J Cullins, Encinitas, CA (US)

( * ) Notice: Subject to any disclaimer, the term of this patent is extended or adjusted under 35 U.S.C. 154(b) by 31 days.

(21) Appl. No.: 14/259,070

(22) Filed: Apr. 22, 2014

(65) Prior Publication Data

US 2015/0303607 A1 Oct. 22, 2015

(51) Int. Cl.

| | |
|---|---|
| ***G09F 3/12*** | (2006.01) |
| ***H01R 13/46*** | (2006.01) |
| ***H01R 24/64*** | (2011.01) |
| ***G09F 3/00*** | (2006.01) |
| ***G09F 3/14*** | (2006.01) |
| ***H01R 43/26*** | (2006.01) |

(52) U.S. Cl.

CPC ..... *H01R 13/465* (2013.01); *G09F 3/0295* (2013.01); *G09F 3/14* (2013.01); *H01R 24/64* (2013.01); *H01R 43/26* (2013.01)

(58) Field of Classification Search

CPC ..... H01R 13/465; H01R 13/641; G09F 3/12; G09F 3/14; G09F 3/04

See application file for complete search history.

(56) References Cited

U.S. PATENT DOCUMENTS

| | | | | |
|---|---|---|---|---|
| 4,311,883 | A * | 1/1982 | Kidney | 379/443 |
| 4,840,582 | A * | 6/1989 | Marson | 439/491 |
| 4,964,284 | A * | 10/1990 | McDaid | 70/14 |
| 5,908,110 | A * | 6/1999 | Hirai | 206/345 |
| 6,520,796 | B1 * | 2/2003 | Reichle | 439/491 |
| 6,735,895 | B2 * | 5/2004 | Wada et al. | 40/664 |
| 7,530,821 | B2 * | 5/2009 | Miyake | 439/135 |
| 7,794,270 | B1 * | 9/2010 | Lin et al. | 439/491 |
| 8,556,522 | B2 * | 10/2013 | Cunningham | 385/75 |
| 2002/0058439 | A1 * | 5/2002 | Ewell et al. | 439/491 |
| 2006/0009068 | A1 * | 1/2006 | Greene et al. | 439/488 |
| 2011/0104937 | A1 * | 5/2011 | Singh | 439/488 |
| 2013/0330965 | A1 * | 12/2013 | Hildebrandt | 439/559 |

* cited by examiner

*Primary Examiner* — Gary Paumen

(74) *Attorney, Agent, or Firm* — Buche & Associates, P.C.; John K. Buche

(57) ABSTRACT

The present invention relates to a plug that can be fit into network ports. The plug features a flexible extrusion that fits into a aperture in the back of the plug. The when the flexible extrusion is linked into the aperture, it creates a loop that can hold a hang tag. The hang tag can be used to label the plug. The loop created by the plug can be tightened, so that it fits around a cable, in order to label the cable, once the plug has been removed from the socket.

12 Claims, 7 Drawing Sheets

DATA CONNECTOR AND LABELING APPARATUS

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF INVENTION

1. Field of the Invention

The disclosed subject matter is in the field of plugs for information technology.

2. Background of the Invention

Often times, large companies will have server rooms with hundreds, and maybe thousands of network ports. Some of these ports will have cables plugged into them; some will not. Sometimes ports are numbered, but at times it can be impossible to know which port is wired and where it terminates. When maintenance must be performed on the network system, often times it means that a network engineer must test each port individually to determine where it is hooked up. This can be a laborious process. Furthermore, endless streams of cables can be a nightmare for network engineers. Trying to figure out what cable corresponds to which office, floor, network, etc. can be a daunting task. A simple device that can plug into a network port that provides a labeling mechanism that can also sever as a labeling mechanism for cables can solve much of the aggravation involved in network maintenance for large companies or industries. In addition, empty jacks can pose security risks. Unauthorized users can insert cables into the jacks and potentially infect the network with viruses or malware.

There are several devices that act as blanking plugs for electrical outlets. The most basic device is a seal that can be inserted into an outlet or a jack. For example, U.S. Pat. App. 2013/0330965 to Hildebrandt discloses a seal that can fit over an electrical outlet. The seal closes off the plug, but does not provide a label for said plug.

In addition to basic plugs for outlets, there are some plugs that are also labeled. European Pat. No. 1845300 to Maycock discloses a closure plug for pipes that is labeled. Maycock's plug has a preprinted message on the printed directly on the plug stop. For example, a plug stop might come with the message "Do Not Use" or "Out of Order". While it might be possible to purchase plugs for commonplace names such as "2$^{nd}$ Floor Conference Room" or "Reception Area", it might be difficult or expensive to have labels custom made for every room or location in a large office. Furthermore, there is no flexibility with these labels. If the office configuration changes, a company may have to invest in all new labels.

There are also several examples of plugs for phone jacks and other telecommunication devices which lock. For example, U.S. Pat. No. 4,964,284 to McDaid and U.S. Pat. No. 4,311,883 to Kidney both disclose a telephone lock that fits into a phone jack. The device will lock and can only be removed with a key. While this is useful to prevent tampering, it is not useful if an IT worker needs easy access to the device. Carrying extra keys may be burdensome to an IT professional. When there are thousands of jacks, it would be cumbersome to have to use a key to access a port, especially if there were different keys for different jacks.

There are several inventions for labeling a cable, although they are different from the present invention. The simplest and most common is an adhesive tag that wraps around a cable. The problem with an adhesive tag is that it can be very difficult to remove and is not flexible if the cord needs to be relabeled. There have been several attempts to improve on cord labeling. U.S. Pat. No. 7,530,821 to Miyake discloses a labeling system for cable cords. Miyake describes a plastic wrapper that can fit over a cord. The plastic wrap per has pre printed text on it with a label such as "For Digital Cable", etc. The plastic wrap can be shrink wrapped onto a cable. The problems with this labeling system are similar to the ones associated with the Maycock patent. With pre-printed manufactured labels, there are only so many common labels and to deviate from that requires special orders and could become burdensome.

U.S. Pat. No. 8,556,522 to Cunningham discloses a connector, such as a cable connector or a flash drive with a pull out label. There is a small storage section that houses a label. A user can pull the label out, and using a pen, label what the connector is plugged into. This label is useful, but it may become difficult to relabel if the connector is moved or needs relabeling.

U.S. Pat. No. 4,840,582 to Marson discloses an identification tag for a jack. The jack features a tab that keeps the jack plugged into the socket. The features a plastic rectangular body that sticks out from the jack. A user can place a label on the body of the tag that lets people identify the socket. Because users can label the tag with a stuck on label, it is capable of being relabeled with ease. However, tags cannot be used to identify a cable that is plugged into the jack if the tag is ever removed.

Thus, there exists a need for a tag that can fit into a jack in order to label the jack that is will label the jack, can easily be relabeled, is easy for IT professionals to work with, is relatively inexpensive and can also be used to label any cables that get plugged into the jack.

SUMMARY OF THE INVENTION

It is an object of the present invention to create a device that can easily label network sockets.

It is another object of the present application to create a labeling system that allows for easy and inexpensive ways to relabel network sockets.

It is another object of the present invention to create a device that can also label network cables in addition to network sockets.

The present invention aims to solve the problems associated with past network plugs and labeling systems by creating a plug with a flexible extrusion and an aperture. The flexible extrusion can be inserted into the aperture creating a loop. This ability to form a closed loop allows items to be affixed to or inserted through, said loop. Items may also be affixed to the flexible extrusion when it has not been fully formed into a loop. A label can be inserted into the loop. When a network engineer needs to insert a cable into the socket, the plug can be used to label the cable.

BRIEF DESCRIPTION OF THE FIGURES

The manner in which these objectives and other desirable characteristics can be obtained is explained in the following description and attached figures in which.

DETAILED DESCRIPTION OF THE INVENTION

Figure 1:
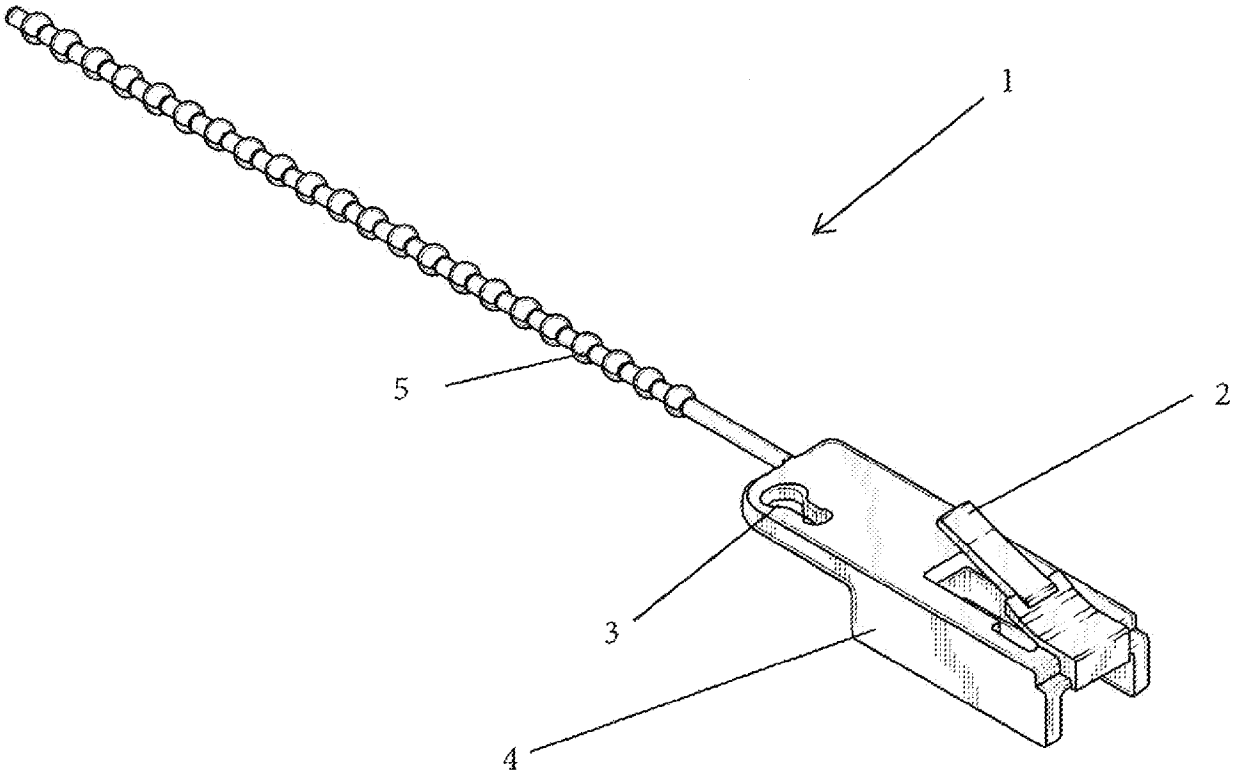
FIG. 1 is a perspective view of a connector.

FIG. 1 shows a perspective view of one embodiment of a connector. In the embodiment shown, the connector is a modular plug. The plug 1 is inert and typically has no electrical or networking capability. The plug 1 features a leaf spring 2, an aperture 3, a body 4, and a flexible extrusion 5. In the embodiment depicted, the flexible extrusion 5 is beaded. The flexible extrusion is capable of forming a loop with the plug by fitting into the aperture 3. The aperture 3 is embedded inside of the body 4. In the embodiment depicted, the aperture 3 has one a wide section (see FIG. 6, 31) and a narrow section (see FIG. 6, 32). The wide section 31 is wide enough so that the flexible extrusion 5 is able to fit through the hole creating a loop. The narrow section 32 of the hole is wide enough, so that the narrow portions of the flexible extrusion 5 can fit snugly through the narrow section 32 of the aperture 3, but the wide portions of the flexible extrusion 5 cannot. The design of the aperture 3 allows for the flexible extrusion 5 to stay in place when it forms a loop. In an alternate embodiment, instead of an aperture, the plug 1 may feature a closing mechanism that is a hook, a clasp, or a toggle.

The leaf spring 2 is a mechanism that allows for the plug 1 to fit securely into a socket and clip in. Once the modular plug 1 is inserted into a socket, the leaf spring 2 will keep the plug 1 secure until the tab of the leaf spring 2 is depressed. Depressing the leaf spring 2 tab allows a user to remove the modular plug 1 from a socket.

The body 4 is configured to fit in a standard socket. Embodiments include plugs 1 where the body 4 is configured to fit in RJ45 and RJ11 sockets. The body 4 of the modular plug 1 is preferably made of plastic (usually high density polypropylene or polyethylene) or another material used for the construction of modular plugs. The flexible extrusion 5 is suitably made of plastic, PVC, or another flexible material that is sturdy and does not break easily. The leaf spring 2 is preferably constructed from the same plastic material as the body 4. In some embodiments, the leaf spring 2 may contain a metal springing mechanism.

Figure 3:
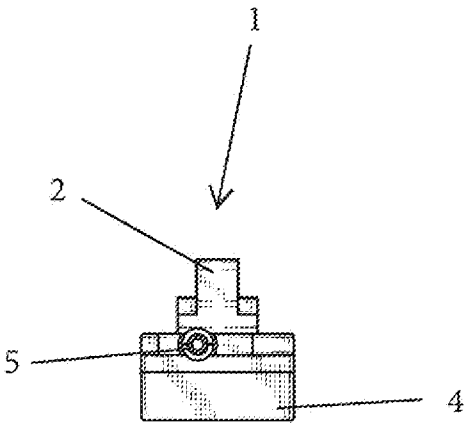
FIG. 3 is a rear view of the connector of FIG.
Figure 2:
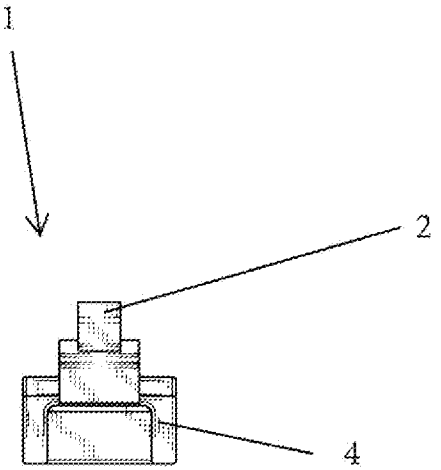
FIG. 2 is a front view of the connector of FIG. 1.
Figure 4:
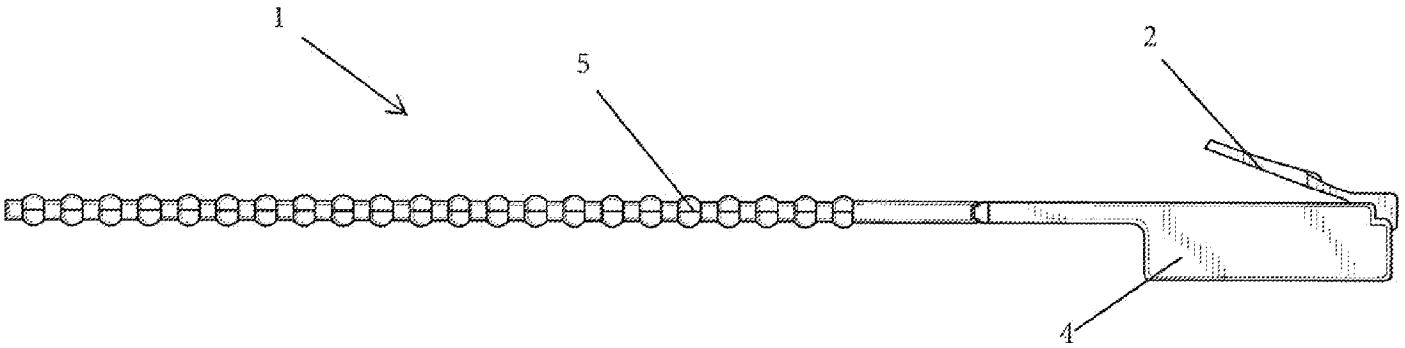
FIG. 4 is a left side view of the connector of FIG. 1.
Figure 5:
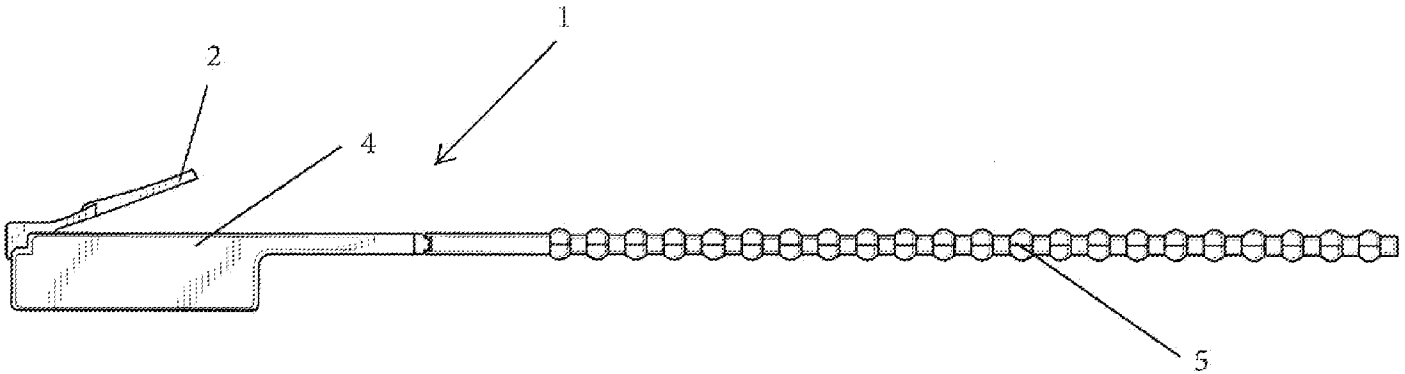
FIG. 5 is a right side view of the connector of FIG. 1.

FIGS. 2 through 5 depict additional views of the embodiment shown in FIG. 1. FIG. 2 is a front view, FIG. 3 is a rear view, FIGS. 4 and 5 are side views.

Figure 6:
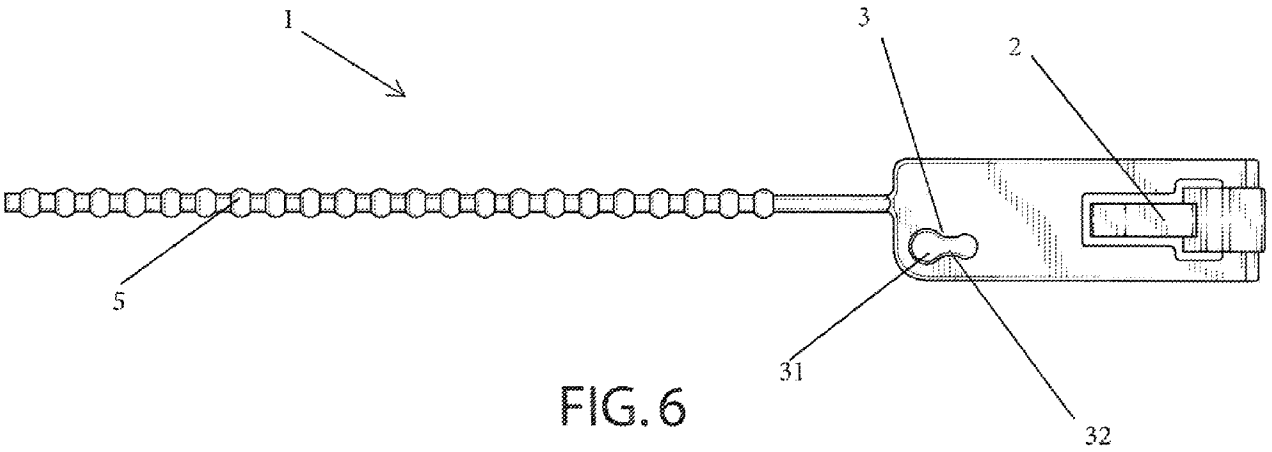
FIG. 6 is a top view of the connector of FIG. 1.
Figure 7:
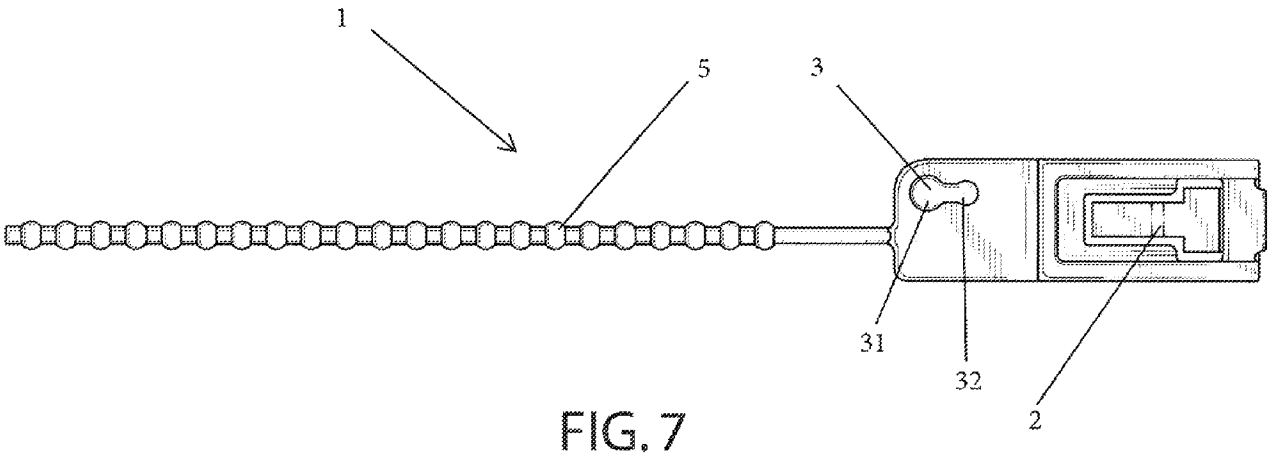
FIG. 7 is a bottom view of the connector of FIG. 1.

FIGS. 6 and 7 show top and bottoms views of the embodiment depicted in FIG. 1. From this angle, the shape of the aperture 3 is apparent. The aperture 3 has a wide section 31 and a narrow section 32 in order to secure the flexible extrusion 5 and create a loop.

Figure 8:
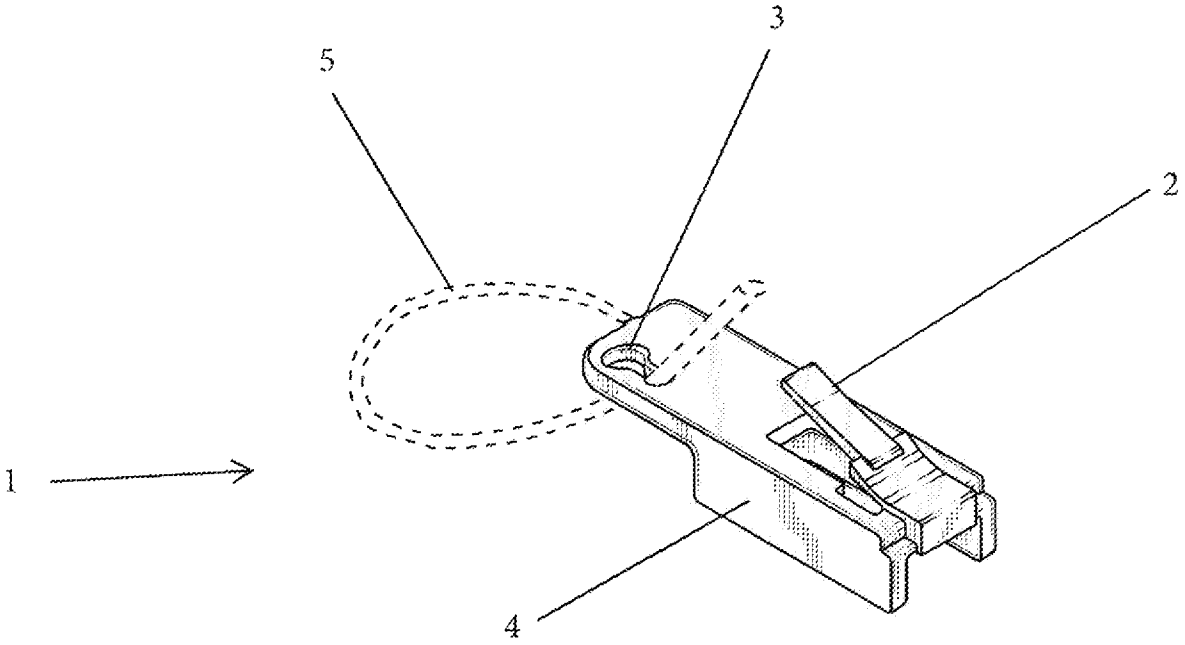
FIG. 8 is a perspective view of the connector of FIG. 1 that shows how a label attaches to the connector.

FIG. 8 shows how the flexible extrusion 5 interacts with the aperture 3 in order to create a loop.

Figure 9:
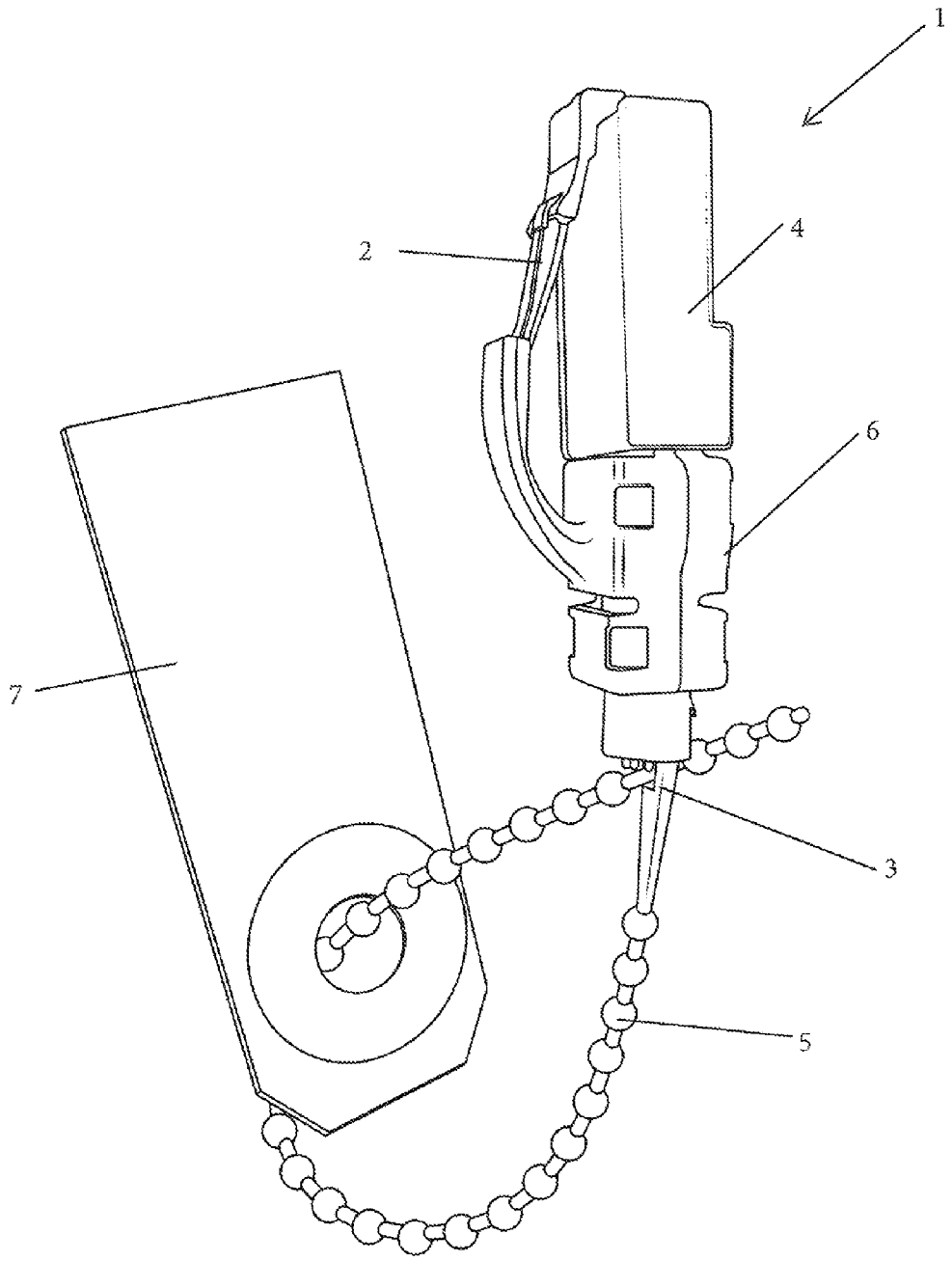
FIG. 9 is perspective view of an alternate embodiment of the connector.

FIG. 9 depicts an alternate embodiment of the modular plug 1. In this embodiment, the plug 1 also has a protection boot 6 that guards the leaf spring 2. Leaf springs 2 can become strained over time because of constant use and as a result of this strain, the leaf spring 2 can break. A protection boot 6 reduces the strain on the leaf spring 2, increasing the life span of the plug 1. The protection boot 6 may be made of PVC or another flexible polymer. Because of the addition of the protection boot 6, the aperture 3 is located next to the flexible extrusion 5.

FIG. 9 also sows how the plug 1 can be used to label sockets. A tag 7 can be inserted around the flexible extrusion 5. The tag 7 will remain securely on the flexible extrusion 5 once the flexible extrusion is used to create a loop. The tag 7 can be any commercially available tag capable of fitting around the flexible extrusion 5. The tag 7 may an inexpensive label made of paper, cardstock, or it may be a more made of a sturdier material such as plastic or vinyl. The tag 7 can be easily labeled with a pen before or after it is secured to the modular plug 1. If the plug 1 needs to be relabeled, a user can easily replace the tag 7 with a new one by removing the flexible extrusion 5 from the aperture 3, replacing the old tag 7 with a new one, and reconstructing the loop. Additionally a tag 7 or another type of label can be affixed to the loop, instead of inserted through the loop. A tag 7 can also be affixed to or inserted through the flexible extrusion 5 when the flexible extrusion has not been fully formed into a loop.

Figure 10:
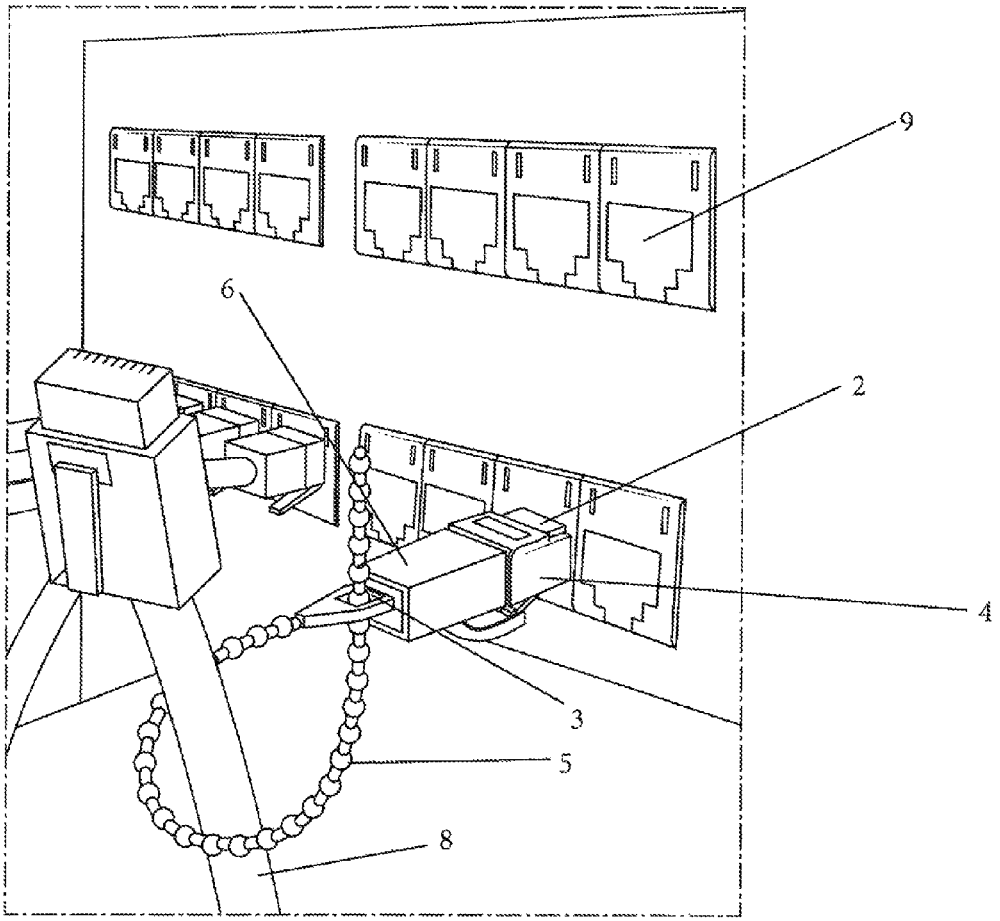
FIG. 10 is an environmental view of the connector of FIG. 8 that shows how it can be used to label cables.

FIG. 10 is an environment view that shows the plug 1 in a socket 9. FIG. 10 also shows how the plug 1 can be used to label a cable 8, when a network cable 8 needs to be plugged into the socket 9. The flexible extrusion 5 can be fitted around the cable 8 and tightened by adjusting the position of the flexible extrusion 5 in the aperture 3. In addition to labeling cables 8, the plug 1 can also be used to label other items.

In an alternate embodiment, the connector is not a modular plug, but an ST connector. The connector can also be adapted to fit with other types of ports and outlets.

Any element in a claim that does not explicitly state "means for" performing a specified function, or "step of" in the clause as specified in 35 U.S.C. §112 paragraph 6 may not be intended as a means plus claim.

The invention claimed is:

1. A connector comprising:

a flexible extrusion protruding from the back end of a body;

a closing mechanism allows the flexible extrusion to form a loop; and, where the connector is a modular plug.

2. A connector according to claim 1 further comprising a leaf spring.

3. A connector according to claim 2 wherein the flexible extrusion is beaded.

4. A connector according to claim 3 where the closing mechanism is an aperture.

5. A connector according to claim 4 wherein the aperture is embedded in the body.

6. A connector according to claim 2 where the closing mechanism is selected from the group consisting essentially of a hook, a clasp, a toggle.

7. A connector according to claim 4 wherein the aperture is located next to the flexible extrusion.

8. A connector according to claim 4 wherein the aperture features a wide section and a narrow section.

9. A connector according to claim 2 further comprising a protection boot.

10. A connector according to claim 2 compatible with an RJ45 socket.

11. A connector according to claim 2 compatible with an RJ11 socket.

12. A method of labeling a device comprising:

obtaining an modular plug with a flexible extrusion and a hole;

inserting a tag around the flexible extrusion;

inserting one end of the flexible extrusion into the hole, creating a loop; and, tightening the loop around a network device.

* * * * *